United States Patent [19]

Lowry

[11] Patent Number: 4,785,541

[45] Date of Patent: Nov. 22, 1988

[54] BOW MOUNTED RANGE FINDER FOR TREE STANDS

[76] Inventor: Abner P. Lowry, 4512 Hartman Rd., Jacksonville, Fla. 32226

[21] Appl. No.: 919,657

[22] Filed: Oct. 16, 1986

[51] Int. Cl.[4] ..... F41G 1/46

[52] U.S. Cl. ..... 33/265; 124/87; 33/377

[58] Field of Search ..... 33/265, 281–284, 33/348, 348.2, 351, 353, 367, 390, 377, 379, 334; 124/86, 87

[56] References Cited

U.S. PATENT DOCUMENTS

| | | | |
|---|---|---|---|
| 1,261,776 | 4/1918 | D'Ascanio | 33/348 |
| 1,305,935 | 6/1919 | Rieker | 33/377 |
| 1,705,425 | 3/1929 | Swanson | 33/348.2 |
| 1,970,883 | 8/1934 | Bryant | 33/377 |
| 2,570,122 | 10/1951 | Heckert et al. | 33/377 |
| 3,289,300 | 12/1966 | Jordan | 33/265 |
| 3,355,809 | 12/1967 | Guyton | 33/265 |
| 3,368,282 | 2/1968 | Gibson et al. | 33/265 |
| 4,120,096 | 10/1978 | Keller | 33/265 |
| 4,214,372 | 7/1980 | Rusbach | 33/283 |
| 4,231,162 | 11/1980 | Button | 33/284 |
| 4,368,581 | 1/1983 | Tullos | 33/265 |
| 4,580,349 | 4/1986 | Webb et al. | 33/265 |

FOREIGN PATENT DOCUMENTS

| | | | |
|---|---|---|---|
| 124522 | 4/1919 | United Kingdom | 33/348 |
| 449614 | 6/1936 | United Kingdom | 33/377 |

*Primary Examiner*—William A. Cuchlinski, Jr.
*Assistant Examiner*—Patrick R. Scanlon

[57] ABSTRACT

A bow mountable range finder for elevated tree stand use includes a housing and a triangular tubular chamber containing air and medium viscosity liquid. The triangular chamber contains a horizontal venting section, a vertical indicating section, an inclined section and a horizontal reservoir with air and liquid freely movable throughout chamber depending upon the orientation of the range finder. The indicating section is translucent and has a removable graduated scale calibrated for various heights above ground, a battery powered lamp illuminates through the indicating section and scale. A switch is operable by an archer outwardly of the housing.

The reservoir section is sized to accommodate approximately one-half the fluid capacity of the indicating section when the range finder is horizontal and thus allows for rapid lowering of the liquid level when the range finder is rotated counterclockwise. The venting section is sized small enough to impede liquid flow beyond the half full level of the indicating section.

12 Claims, 3 Drawing Sheets

BOW MOUNTED RANGE FINDER FOR TREE STANDS

FIELD OF INVENTION

The present invention generally relates to bow range finders and in particular to range finders for use with an archer's bow when used from an elevated tree stand.

DESCRIPTION OF PRIOR ART

A wide variety of range finding devices are known to the prior art. An example of a range finder is that disclosed in U.S. Pat. No. 2,606,367 (Baumer) wherein a plummet is suspended by a rigid plummet wire. Tilting of the device will allow the readout of the distance on a scale calibrated according to the usual trigonometric principles. The principal disadvantages of the device are the use of moving mechanical components and the time delays associated with operation. The plummet must remain stationary in order to lock the wire in a position to lock it and read the position and range. See also U.S. Pat. Nos. 1,253,877 (Payne); 1,398,853 (Ginzbourg); and 2,279,321 (Janssen).

A number of fluid-filled level devices that can be used in a distance measuring apparatus include U.S. Pat. Nos. 1,199,224 (Wolff); 1,261,776 (D'Ascanio); 3,208,147 (Estes); 3,483,624 (Smith); and 3,568,325 (Baltz). All of these devices contain a tubular system employing a fluid and a calibrated scale. The distance from the horizontal is measured from the user to a given point in the distance by a line-of-sight pointing.

A device designed specifically for use with weapons is disclosed in U.S. Pat. No. 4,214,372 (Rusbach). This device can utilize balls that move along a race or a liquid in a tube for providing information regarding angular displacement from the horizontal. Oscillations in the liquid-filled variation of the invention are prevented by way of a ball residing in the fluid so as to damp liquid movement. A different type of liquid level inclinometer utilizing a surge protector valve is disclosed in U.S. Pat. No. 2,059,551 (Christensen).

Two examples of bow sights are U.S. Patent Nos. 3,013,336 (Pennington) and 3,287,300 (Jordan). The Pennington sight employs a rigidly mounted pointer and a movable arcuate strip for measuring the degree of tip of the bow from the horizontal plane. The Jordan sight uses a circular fluid-filled annulus to measure degree of inclination or declination of the bow from the horizontal. Both these prior art sights are simply methods for measuring an angle at which a bow is raised or lowered. By trial and error an archer can become accustomed to the proper angle of arrow flight for repeatable results when using these prior art sights.

All of the above devices are not adaptable for use as bow range finders used on elevated stands because where the straight line distances between the bow and the target can be calculated by simple trigonometric principles, the devices are based upon the assumption that the archer is shooting from flat ground to a target on flat ground. For example, if an archer were on an elevated stand in a tree, the prior art devices would provide tranjectory data for the interception of the arrow line-of-flight with the horizontal plane associated with the surface the archer is standing on. This data is quite irrelevant when shooting from an elevated stand.

There has been a long-felt need for a reliable and accurate range finder that provides an archer with data on the horizontal distance between a point directly below his elevated position and the target so that proper sighting via distance pins can be used to shoot the bow at the target.

The range finder should be usable in low light levels or in foul weather - not possible with much of the prior art.

A distinct disadvantage of the prior art is the use of apparatus that extends outwardly from the plane of the bow. This limits the usefulness of the prior art in tight quarters such as in brush or near dense tree limbs. The range finder should be small and light and not have any protrusions or apparatus that can get caught in tree limbs and the like. Finally, the range finder should have a minimum of moving parts that can wear out or be jammed by debris. None of the devices in the prior art disclosed above satisfies the aforementioned needs.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

SUMMARY OF THE INVENTION

Figure 1:
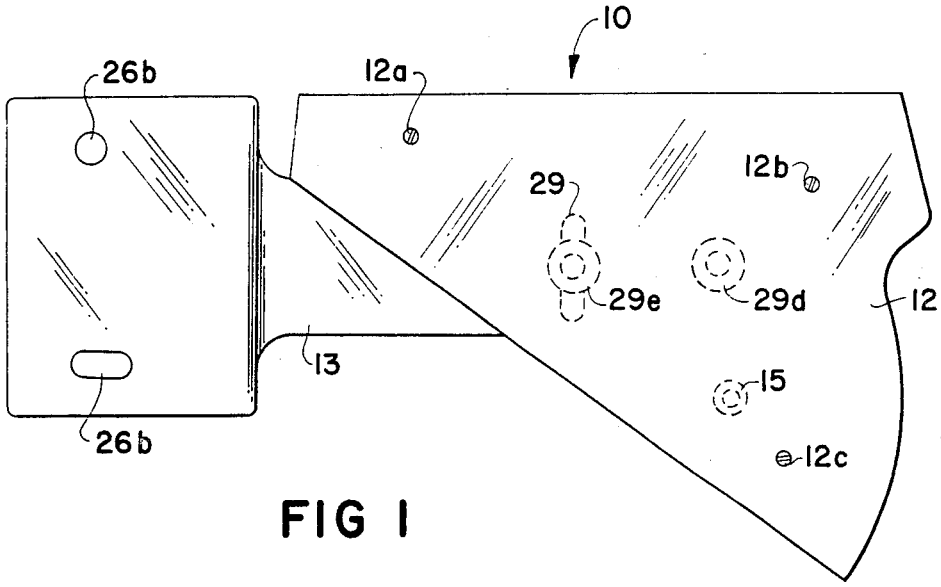
FIG. 1 is a side elevational view of the range finder according to the invention secured to the range finder frame.

In accord with this invention a bow mountable range finder for elevated tree stand use is provided and includes a housing for an integrally formed tubular triangular chamber containing a quantity of air and liquid. A means mounts the chamber in the housing with the tubular chamber having an elongated horizontal venting section with opposite end portions, a vertically extending translucent indicating section with opposite end portions, an inclined section with opposite end portions, and a horizontally disposed reservoir. The end portions of the venting section are respectively connected between the reservoir and one of the end portions of the indicating section. The end portions of the inclined section are respectively connected between the reservoir and the other of the end portions of the indicating section. A translucent graduated scale is positionable rearwardly of the indicating section for reading the liquid level in the section by an archer and a means removably secures the scale to the housing.

Other aspects of the invention include a series connected lamp, battery, and switch means for selectively energizing the lamp via the battery and a means for mounting it in and to the housing and positioned to emit light through the vertically disposed translucent indicating section. The scale is used for reading the liquid level in the indicating section according to the non linear gradations imprinted thereon.

The range finder includes a bolt and frame for pivotably attaching it to a bow.

The range finder has sized reservoirs and venting sections to be substantially empty of liquid when the scale is above the highest yard mark thereon. The reservoir section is sufficiently large to accommodate a rapid removal of fluid from generally the upper half of the indicating section via the inclined section when the range finder is pivoted counterclockwise about its transverse axis.

In addition, the range finder has the horizontally disposed venting section and is sized to provide a dynamic back pressure against the liquid level in the indicating section when the range finder is pivoted counterclockwise about its transverse axis beyond the fully filled position of the reservoir section.

The range finder has a housing which includes a integrally formed planar triangular side wall and a laterally extending inclined edge with the inclined section being disposed along the inclined edge with means for removably securing said scale including a pair of spaced shoulders of the housing engageable with spaced portions of the scale and a removable triangular side wall cover. The side wall cover is removably secured to the housing using three spaced screws with internal laterally disposed posts for use with the screws in a conventional manner.

The indicating lamp is located forwardly of the indicating section and a reflector is used to uniformly reflect light along the indicating section. The indicating lamp is illuminated via a switch which extends outwardly through the range finder housing cover.

A number of scales are used with the range finder. Each scale is used with a given height consisting of the archers vertical height off the ground, such as a tree stand, and the shoulder height of the archer. A storage compartment located above the horizontal venting section is used to store the scales that an archer may use. A longitudinal access door covers the storage compartment. The access door contains a vertically disposed edge which fits into a slot to secure it into place. The lower edge of the door edge is painted a bright color which is not visible if the door edge is secured in the slot.

DESCRIPTION OF THE PREFERRED EMBODIMENT

Figure 2:
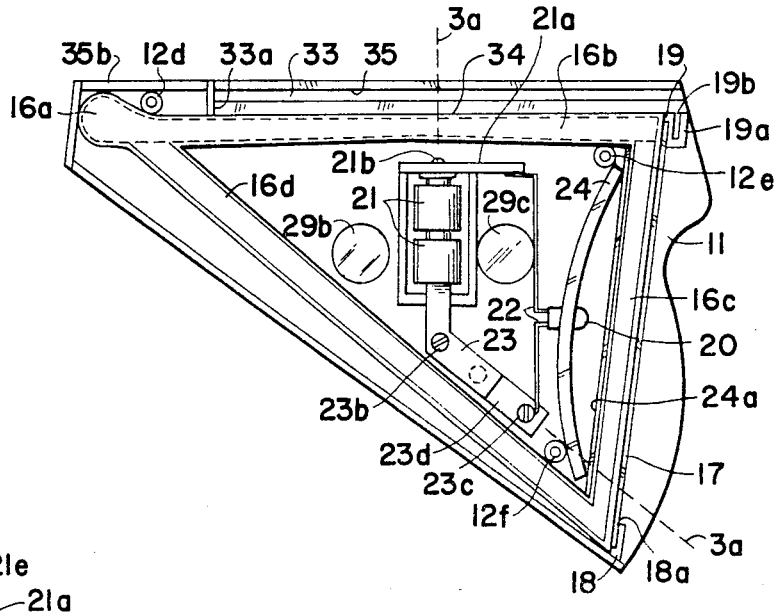
FIG. 2 is a side elevational view of the range finder with the side panel removed to illustrate the internal components of the range finder.

Referring now more particularly to the drawing, the range finder in accord with the invention is generally designated by numeral 10 and is attached to a bow as illustrated in FIGS. 1, 7, 8, and 9. The range finder 10 includes a housing 11 and a removable side panel 12 which is secured to the housing 11 by way of three spaced screws, 12*a*, 12*b*, 12*c*, which secure to three outwardly extended and spaced posts 12*d*, 12*e*, 12*f*. Posts 12*d*–12*f* are integrally formed as part of housing 11(FIG. 2). In the preferred embodiment of the range finder 10, the housing 11 and side panel 12 are molded plastic parts. The range finder 10 is secured to the bow 14 by way of screws 28, 28*a* and frame 13 as will be discussed in more detail below.

A liquid-filled generally triangular chamber 16 is composed of four integrally-connected sections: a reservoir 16*a;* an air vent channel 16*b* disposed horizontally; a vertical indicating channel 16*c;* and an inclined channel 16*d*. The reservoir 16*a* is a generally spheroid cavity sized to hold approximately one-half the amount of liquid capacity of vertical indicating section 16*c* which is a relatively narrow cylinder. The lower surface of channel 16*b* is angled upward to an apex to prevent liquid from remaining in the channel 16*b* when the range finder 10 is in the normal, horizontal position. Channel 16*b* is sized both in depth and in width to provide a restriction to flow (back pressure) for liquid moving from reservoir 16*a* —when it is full—to channel 16*b*. Inclined channel 16*d* is also completely filled with liquid when the range finder 10 is in the horizontal position.

Figure 5:
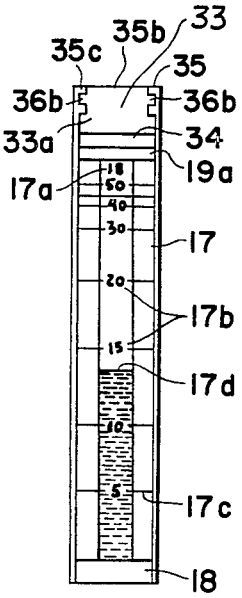
FIG. 5 is a rear view of the range finder showing the indicating channel with one indicating strip installed.

The level of fluid in the indicating channel 16*c* is read out through a calibrated strip 17. A plurality of strips 17 are provided, each with a height indication 17*a* (i.e., 18 feet) as seen in FIG. 5. The height indication 17*a* is the tree stand height plus the height of the archer's shoulder. Retaining means in the form of vertically disposed edge 18 and U-shaped edge 19 secure the strip 17 in place and allow for easy removal and replacement with another strip 17 by the archer.

Lamp 20 is supplied an electric current from one or more batteries 21 via conductors 22 connected to a reed type switch 23 that is actuated closed by a suitable contact from knob 15. Knob 15 may be plastic bolt or the like with a restricted travel limit sufficient to selectively actuate reed switch 23 and as knob 15 is rotated clockwise, it closes reed switch 23 and lamp 20 is illuminated. Arcuate reflector 24 functions to direct light toward and through strip 24*a*. Vertical strip 24*a* preferably is a light diffusing plastic strip that diffuses the light from lamp 20 to illuminate arcuate strip 17 along its vertical length to allow for easy reading of liquid level indicated by 17*d*. Arcuate reflector 24 is preferably resilient and positioned and maintained in place by being biased against screw posts 12*e*, 12*f* with the lamp 20 extending therethrough generally centrally thereof.

Figure 8:
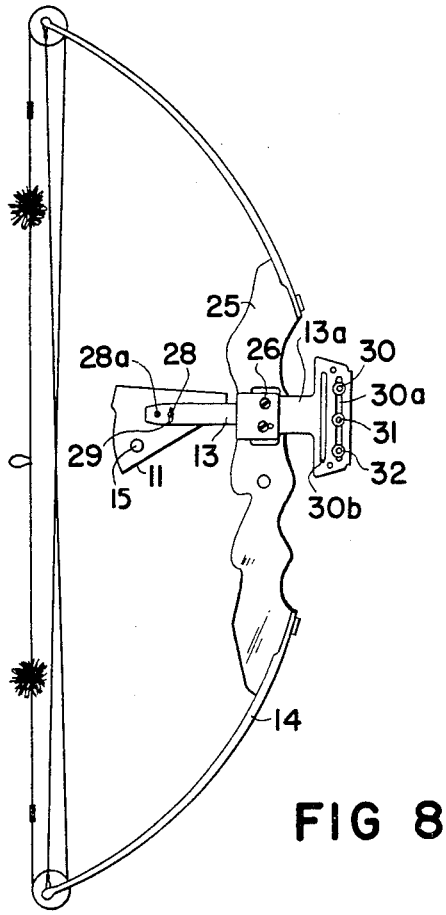
FIG. 8 is a reduced side elevational view of the range finder secured to a bow.
Figure 9:
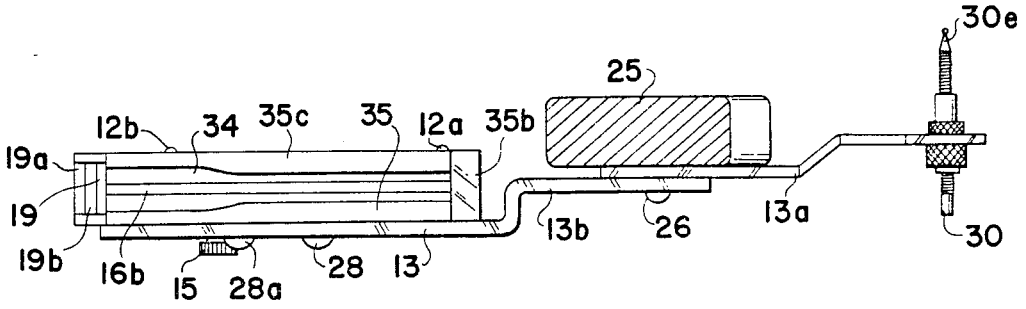
FIG. 9 is a top view of the range finder secured to a bow, the bow handle illustrated in cross-section.

Range finder frame 13 is secured to the handle 25 of the bow 14 by spaced screws 26, 26*a* as seen in FIGS. 8, 9. The range finder housing 11 is secured to frame 13 by means which may be a single threaded bolt 28. The slot 29 for bolt 28 is vertically elongated to allow for initially pivotally positioning the range finder on the bow 14 in a vertical manner and to be secured into a final position by tightening screw 28. Bolt hole 26*b* is horizontally elongated to allow for vertical positioning of sighting pin frame 13*a* about a point defined by bolt 26.

The range finder 10 is calibrated by using conventional shooting pins 30, 31, 32 that are attached to the bow 14. From a known vertical height, an arcuate strip 17 marked with the given height is placed into the slot formed by and between edges 18 and 19. The archer can then sight with the desired shooting pins 30–32 to a point a known horizontal distance away from a point directly below him. Range finder 10 can be rotated until the indicating fluid is at a level corresponding to a marking of the known horizontal distance. Screw 28 can be tightened to secure the range finder in the appropriate position by way of elongated slot 29.

With the range finder now calibrated, the archer can sight a target with the shooting pin used in calibration, read the range from the strip 17 and select the proper shooting pin before releasing the arrow.

The liquid used in chamber 16 is a low viscosity fluid which may contain a wetting agent and is added to reduce surface tension and thus allows for a more level liquid surface and to prevent liquid adherence to the various chamber 16 surfaces. Preferably the liquid contains tinting for increased contrast and easier viewing.

As a general proposition archers tend to lower their bow from an elevated position when sighting a target. As the bow is lowered around a pivot point defined by the archer's shoulder, the range finder 10 will be tilted in a manner to cause the liquid in the vertically disposed indicating section 16c to flow out. Because inclined channel 16d is normally filled as shown in FIG. 1, the fluid in channels 16c and 16d flows into reservoir 16a. This results in a rapid lowering of the level in indicating channel 16c because the fluid flows without any back pressure. The rapid lowering of the liquid level in channel 16c will continue to the point when reservoir 16a is filled. At this point, the narrower sizing of channel 16b will result in a back pressure to reduce the rate at which the liquid level falls. The indicia on indicating strip 17 will be in nonlinear gradations 17b with a given change in distance incrementations being smaller at the longer range, upper portion of strip 17. The sizing of reservoir 16a and channel 16b are designed to achieve back pressure upon the fluid at a liquid level approximately one-half the vertical height of channel 16c. That is to say, the liquid level drops rapidly for the first 50% of liquid level and then drops more slowly to the lower limit. This design allows for rapid and accurate range finding.

Indicating lamp can be illuminated via knob 15 to aid in reading the level in indicating channel 16c.

The range finder 10 includes a plurality of strips 17 each of which has markings for example, 17, 18, 19, 20, 21, 22, 23, 24 feet vertical height. The strips 17 are stored in compartment 33 which is defined by the housing 11 and cover 12, the upper surface 34 of air vent channel section 16b, and a removable access door or cover 36. Cover 36 is a resilient, flat plastic strip riding in parallel guideways 36b formed of flanges 35, 35c and range finder housing 11 and side panel 12. The compartment is terminated with end 33a and reservoir cover 35b, an integral part of housing 11.

The cover 36 has an angled, vertically disposed edge 36c which fits into a slot 19b defined by U-shaped edge 19 with a section 19a parallel to 19b. In the preferred embodiment of the invention edge 19 is integral to and extends laterally outward from housing 11.

Arcuate strips 17 have chemically imprinted permanent markings 17b which are factory adjusted on each strip 17 according to calculations of range, for a given height marking indicated by 17a.

Resilient cover strip 36 has a brightly painted marking 36d along the lower edge of angled edge 36c. This marking 36d is not visible if the edge 36c is properly secured into slot 19b.

Figure 7:
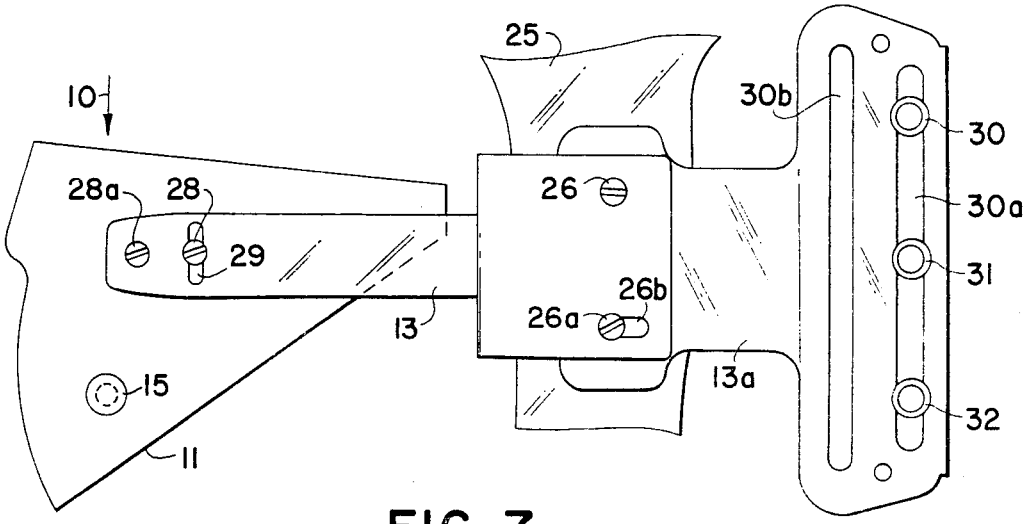
FIG. 7 is a reduced side elevational view of the range finder secured to a bow, the bow being broken away.

FIGS. 7–9 illustrates the range finder 10 secured to frame 13 by way of bolt 28 which allows the range-finder 10 to be pivoted and secured into position once calibrated as discussed above. The bow handle 25 secures the frame 13 to the bow 14 via bolts 26. Shooting pins 30, 31, 32 are conventional devices which are secured to the pin frame 13a. In the preferred embodiment of the range finder 10, frames 13 and 13a are separate frames secured to the bow handle 25 by a single set of bolts 26, 26a.

Figure 3A:
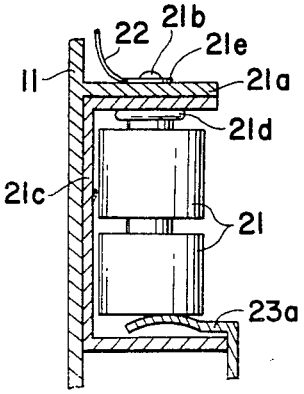
FIG. 3*a* is a cross-section of the battery assembly taken on the line 3*a*—3*a;*
Figure 3B:
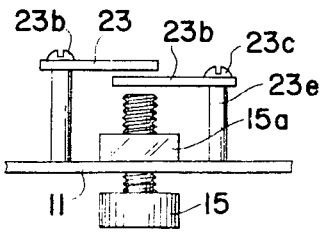
FIG. 3*b* is an enlarged detail of the reed switch assembly.
Figure 4:
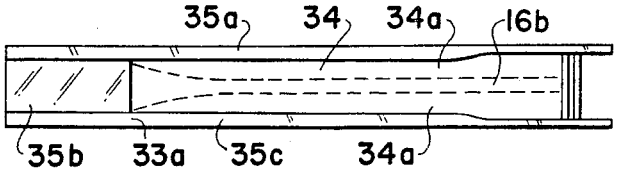
FIG. 4 is a top view of the range finder with the sliding compartment cover removed to clearly illustrate the horizontal air vent channel.

FIGS. 3a and 3b are details of he interior illustrating one or more batteries 21 in holder 21c. Holder 21c is glued to housing 11. Reed switch 23 operates closed when leaf 23b is pushed by bolt 15 to make contact. Laterally extending posts 23c and 23f are used with screws 23b and 23c to secure the assembly onto housing 11. Boss 15a is the fixed riding nut for bolt 15. Battery terminal 23a is curved slightly to make contact with the negative terminal of a battery 21. In the preferred embodiment of the invention, terminal 23a is an integral part of leaf 23d. This is done for simplicity of fabrication.

Brad 21b secures battery contact spring 21d to holder 21c through edge 21a. One conductor 22 is secured electrically to battery contact 21d via terminal 21e held in place by way of brad 21b. The other conductor 22 is secured to screw 23c by wrapping or by a terminal in a conventional manner.

Figure 6:
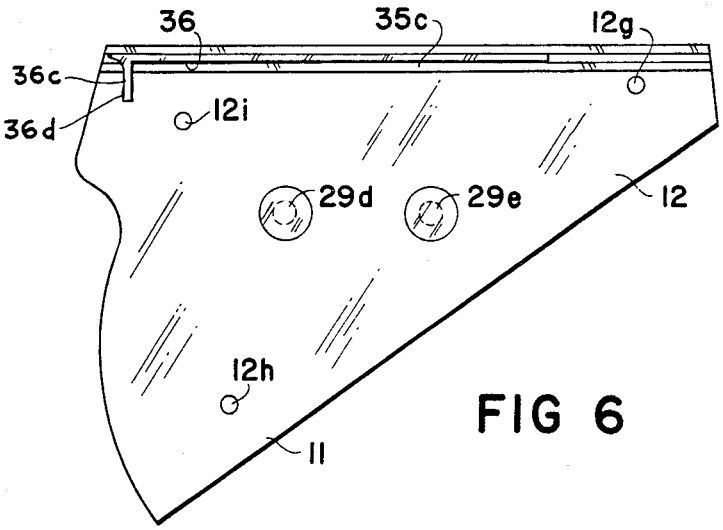
FIG. 6 is a side elevational view of the internal surface of the housing side section illustrating the position of the sliding compartment cover when in place.

FIGS. 6 and 2 illustrate closed-end bosses 29b, 29c, 29d, and 29e which allow the range finder 10 to be secured to either the right or left-handed side of frame 13 in order to minimize interference with the arrow and bow string draw.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A bow mountable range finder for elevated tree stand use comprising a housing, an integrally formed tubular triangular chamber containing a quantity of air and liquid, means mounting said chamber in said housing, said tubular chamber including an elongated horizontal venting section having opposite end portions, a vertically extending translucent indicating section having opposite end portions, an inclined section having opposite end portions and a horizontally disposed reservoir section, respective said end portions of said venting section being connected between said reservoir and one of said end portions of said indicating section, respective said end portions of said inclined section being connected between said reservoir and the other of said end portions of said indicating section, said indicating section and said inclined section being substantially filled with liquid when said venting section and said reservoir section are disposed horizontally, a translucent graduated precalibrated scale having yard marks thereon and positionable rearwardly of said indicating section for reading the liquid level in said indicating section by an archer, means for removably securing said scale to said housing.

2. The range finder as in claim 1 further including a series connected lamp, battery, and switch means for selectively energizing said lamp via said battery, means for mounting said lamp in and to said housing and positioned to emit light through said vertically extending translucent indicating section and said scale for reading the liquid level in said indicating section according to said scale.

3. The range finder as in claim 1, further including means for pivotably attaching said range finder to a bow.

4. The range finder as in claim 1 wherein said reservoir and venting sections are substantially empty of liquid when the liquid level is above a highest yard mark of said scale, said reservoir section being sufficiently large to accommodate a rapid removal of fluid from generally the upper half of said indicating section via said inclined section when said range finder is pivoted counter-clockwise about its transverse axis.

5. The range finder as in claim 4 wherein said tubular chamber has said horizontal venting section sized to provide a dynamic back pressure against the liquid level in said indicating section when said range finder is pivoted counter-clockwise about its transverse axis beyond the fully filled position of said reservoir section.

6. The range finder as in claim 1 wherein said housing includes a integrally formed planar triangular side wall and at least a laterally extending inclined edge with said inclined section being disposed along said inclined edge, said means for removably securing including a pair of spaced shoulders of said housing engageable with spaced portions of said scale, a removable triangular side wall cover, means for releasably attaching said cover to said housing.

7. The range finder as in claim 1 wherein said reservoir and venting sections are substantially empty of liquid when the liquid level is above a highest mark of said scale, said reservoir section being sufficiently large to accommodate a rapid removal of fluid from generally the upper half of said indicating section via said inclined section when said range finder is pivoted counter-clockwise about its transverse axis, said tubular chamber has said horizontally disposed venting section sized to provide a dynamic back pressure against the liquid level in said indicating sections when said range finder is pivoted counter-clockwise about its transverse axis beyond the fully filled position of said reservoir section, further including a series connected lamp, battery, and switch means for selectively energizing said lamp via said battery, means for mounting said lamp in and to said housing and positioned to emit light through said vertically extending translucent indicating section and said scale for reading the liquid level in said indicating section according to said scale.

8. The range finder as in claim 7 wherein said housing includes a integrally formed planar triangular side wall and at least a laterally extending inclined edge with said inclined section being disposed along said inclined edge, said means for removably securing including a pair of spaced shoulders of said housing engageable with spaced portions of said scale, a removable triangular side wall cover, means for releasably attaching said cover to said housing, said switch means extending outwardly of said housing for manipulation by an archer.

9. The range finder as in claim 8 wherein said lamp is located forwardly of said indicating section, and reflector means associated with said lamp to generally uniformly reflect light along said indicating section.

10. The range finder as in claim 9 wherein said housing further includes a scale storage compartment for a plurality of precalibrated scales above said venting section, said compartment including an access door for selective removal of one of said scales located therein.

11. A range finder adapted to be attached to a bow comprising:

a housing, an integrally formed tubular chamber contained in said housing, a medium viscous liquid with a wetting agent to cause the liquid to be substantially non-adhering said chamber including a horizontal reservoir section, a horizontally disposed venting section, an inclined section, and a vertically disposed translucent indicating section, said reservoir section being sized to accommodate a rapid removal of fluid from generally one half of said indicating section via said inclined section when said range finder is moved counterclockwise about its transverse axis, said venting section being sized to provide a dynamic back pressure against the liquid level in said indicating section when said range finder is further pivoted counterclockwise about its transverse axis after fill up of said reservoir, and a graduated scale removably secured to said housing and positioned adjacent the exterior surface of said indicating section for reading the liquid level in said indicating section on said scale.

12. The range finder as in claim 11 wherein said housing includes a storage compartment for removably receiving a plurality of graduated scales for various heights of a tree stand plus the normal shoulder height of an archer.

* * * * *